US005347931A

United States Patent [19]

Day

[11] Patent Number: 5,347,931

[45] Date of Patent: Sep. 20, 1994

[54] COMBUSTIBLE FLARE IGNITION SYSTEM

[75] Inventor: Evan E. Day, Brigham City, Utah

[73] Assignee: Thiokol Corporation, Ogden, Utah

[21] Appl. No.: 974,746

[22] Filed: Nov. 12, 1992

[51] Int. Cl.[5] ..... F42B 10/56; F42B 12/42

[52] U.S. Cl. ..... 102/340; 102/275.6; 102/342; 102/380

[58] Field of Search ..... 102/336, 337, 340, 342, 102/380, 200, 205, 275.6, 275.11, 378

[56] References Cited

U.S. PATENT DOCUMENTS

| | | | |
|---|---|---|---|
| 1,312,499 | 8/1919 | Holt | 102/340 |
| 1,434,784 | 11/1922 | Lucas | 102/340 |
| 1,588,639 | 6/1926 | Wiley | 102/340 |
| 1,621,421 | 3/1927 | Kunzer | 102/340 |
| 1,683,940 | 9/1928 | Wiley | 102/340 |
| 1,817,503 | 8/1931 | Anderson | 102/340 |
| 2,271,224 | 1/1942 | Goddard | 244/139 |
| 2,362,534 | 11/1944 | Brandt | 102/337 |
| 2,394,896 | 2/1946 | Cavanagh | 102/340 |
| 2,394,897 | 2/1946 | Cavanagh | 102/340 |
| 2,503,269 | 4/1950 | Hickman | 102/340 |
| 3,055,300 | 9/1962 | Stoehr | 102/337 |
| 3,113,752 | 12/1963 | Brestel | 244/147 |
| 3,221,656 | 12/1965 | Sutten | 103/348 |
| 3,491,689 | 1/1970 | Francois | 102/340 |
| 3,515,362 | 6/1970 | Richardson et al. | 244/142 |
| 3,593,664 | 7/1971 | Davis et al. | 102/340 |
| 3,605,624 | 8/1971 | Dinsdale et al. | 102/340 |
| 3,706,257 | 12/1972 | Collman | 86/20 R |
| 3,712,232 | 1/1973 | Abel et al. | 102/531 |
| 3,723,206 | 3/1973 | Dinsdale et al. | 149/19 |
| 3,736,877 | 6/1973 | Roberts et al. | 102/337 |
| 3,752,077 | 8/1973 | Roberts et al. | 102/337 |
| 3,773,284 | 11/1973 | Matsuo et al. | 244/142 |
| 3,829,046 | 8/1974 | Matsuo et al. | 244/152 |
| 3,908,938 | 9/1975 | Pravaz | 244/152 |
| 3,946,672 | 3/1976 | Adams et al. | 102/377 |
| 4,029,014 | 6/1977 | Cunningham | 102/337 |
| 4,226,185 | 10/1980 | Tobler et al. | 102/340 |
| 4,272,956 | 6/1981 | Lamere et al. | 60/242 |
| 4,404,911 | 9/1983 | Bell et al. | 102/221 |
| 4,440,060 | 4/1984 | Berkley | 89/1.54 |
| 4,649,826 | 3/1987 | Stevens | 102/340 |
| 4,651,648 | 3/1987 | Alon | 102/337 |
| 4,716,830 | 1/1988 | Davis et al. | 102/248 |
| 4,765,247 | 8/1988 | Sorenson et al. | 102/339 |
| 4,793,257 | 12/1988 | Bolieau | 102/221 |
| 5,054,398 | 10/1991 | Dobler et al. | 102/387 |
| 5,239,927 | 8/1993 | Frye et al. | 102/387 |

FOREIGN PATENT DOCUMENTS

| | | |
|---|---|---|
| 899496 | 6/1962 | United Kingdom . |
| 1179804 | 2/1970 | United Kingdom . |
| 1198989 | 7/1970 | United Kingdom . |

OTHER PUBLICATIONS

*M-257 Standoff Illuminating Flare* [product brochure], Thiokol Corporation, Brigham City, Utah (date unknown).

*LUU-2B/B Aircraft-Deployed Illuminating Flare [product brochure], Thiokol Corporation, Brightm City, Utah (date unknown).*

*Primary Examiner*—David Brown

*Attorney, Agent, or Firm*—Madson & Metcalf

[57] ABSTRACT

A combustible ignition system for use in an illuminating flare warhead. The ignition system includes a pickup charge positioned contiguous the separation charge of the ignition initiator. The pickup charge is positioned such that the firing of the separation charge triggers combustion of the pickup charge. The pickup charge extends to a combustible train which comprises a continuous thin-layer explosive composition positioned within a plastic tubing. The firing of the pickup charge creates sufficient shock that the combustible train is detonated. The combustible train extends along the flare casing adjacent the parachute system and the illuminant. At the head end of the warhead, the explosive train connects to an output charge. The explosive shock of the explosive train is sufficient to detonate the output charge. The output charge transfers the combustion to a $BKNO_3$ pellet basket within the illuminant igniter of the warhead. Ignition of the pellet basket ignites a propellant wafer which generates sufficient heat to ignite the illuminating composition of the flare.

32 Claims, 7 Drawing Sheets

COMBUSTIBLE FLARE IGNITION SYSTEM

BACKGROUND

1. The Field of the Invention

The present invention is related to an ignition system for use with a flare warhead. More particularly, the present invention is related to an insensitive flare ignition system utilizing a combustible train to carry an explosive shock from the ignition initiator to the illuminant igniter.

2. Technical Background

Flares of various types have found useful application to accomplish a variety of purposes. For military purposes, for example, it is often desirable to light a particular area at night. A flare may be used to produce light for search and rescue operations, or for various other military purposes. When used in these applications, flares are typically mounted to a rocket motor and launched to a predetermined target area. A parachute is generally mounted to the flare and designed to deploy over the target area, thereby permitting the flare to slowly descend while emitting light.

Typical of prior-art flares is the M-257 Standoff Illuminating Flare, made for the U.S. Army, and designated generally at 10 in FIGS. 1 through 4. As illustrated in FIG. 1, the end of the flare 10 includes a motor adapter 12 upon which a rocket motor may be threadably attached. The flare 10 further includes a fuse 14, a drogue parachute 16, a main parachute 18, flare illuminant 20 and an illuminant ignition system 22.

Fuse 14, housed within the motor adapter 12, is armed upon initial acceleration of the rocket motor. The M-257 employs what is commonly referred to as a "setback fuse" which includes a slider 24 which is of sufficient mass that it compresses a spring 26 upon initial acceleration of the rocket motor. Rocket motors commonly employed in propelling such flares generally have an initial acceleration of about 60 g-forces (approximately 770 $m/s^2$) over a period of about one second.

Upon burn-out of the rocket motor, the slider 24 is forced back to the position illustrated in FIG. 1 by the extension force of the spring 26. Upon reaching the end of its travel, the slider 24 releases a firing pin which fires a primer cap (not shown). The primer cap is positioned contiguous a pyrotechnic delay column (not shown) such that firing of the primer cap ignites the delay column. The delay column burns for a predetermined period of time, generally about nine seconds, while the flare is coasting through the air. While coasting, the flare slows from its maximum velocity of about 2200 ft/sec to about 750 ft/sec.

At the base of the delay column is positioned a propellant wafer 28 which acts as the first separation charge. Upon burnout of the delay column, the separation charge is ignited. The firing of the separation charge results in the buildup of a pressure of approximately 5,000 psi. Upon ignition of the pro pellant wafer 28, a pusher plate 32 bears against the aft end of the drogue parachute housing 34, thereby tending to separate the warhead from the rocket motor. The force of separation resulting from the internal pressure buildup causes shear pins 30 which attach the motor adapter 12 to the remainder of the flare to shear. Upon the shearing of shear pins 30, the motor adapter 12 and rocket motor are released from the warhead, as illustrated in FIG. 2.

Upon separation, the pusher plate 32 falls away from the main parachute housing and becomes subject to the substantial resistance forces imposed by the atmosphere. The pusher plate 32 is attached to the drogue chute 16. Hence, the force of air resistance on the pusher plate 32 pulls the drogue chute 16 out of the housing 34 and permits it to inflate.

At the same time, a deflector plate 36, attached to the motor adapter 12, falls off to the side of the motor adapter 12. The force of air resistance acting on the deflector plate 36 causes the deflector plate 36 to function as a drogue and alter the trajectory of the combined motor adapter 12 and the rocket motor, thereby assisting to prevent the possible collision of the rocket motor with the flare.

With continued reference to FIG. 2, a gas generator 38, mounted within the parachute housing 34, is ignited upon deployment of the drogue parachute 16. A nylon cord or wire 40 connects the bridle 42 of the drogue parachute 16 to a "quick match" 44 located inside the gas generator 38. The cord or wire 40 is shorter than the main drogue line 46; thus, as the drogue parachute deploys, the quick match 44 is pulled out of the gas generator 38 and ignition of the generator is effected.

The gas generator 38 acts as a delay to control how long the drogue parachute is deployed. In the M-257 standard flare, the gas generator 38 provides an approximate two-second delay. The head end of the gas generator 38 is positioned contiguous a propellant wafer 48 which functions as a secondary separation charge. Thus, as the gas generator 38 burns out, it ignites the propellant wafer 48.

In the M-257, the secondary separation charge generates an internal pressure of about 10,000 psi. This pressure causes a second pusher plate 50 to bear against the aft end of the main parachute housing 52 and results in the shearing of shear pins 54 which attach the drogue chute housing 34 to the main chute housing 52. As the shear pins 54 are broken, the drogue chute 16 and the drogue chute housing 34 are separated from the remainder of the flare, as illustrated in FIG. 3.

The second pusher plate 50 then falls out and is exposed at high speed to the atmosphere. The resulting force of air resistance on the second pusher plate 50 deploys a pilot parachute 56 to which the second pusher plate 50 is attached.

The pilot parachute 56 is connected to a main parachute container 58 in which the main parachute 18 is housed. The force on the main parachute container 58 resulting from the deployment of the pilot parachute 56 causes the main parachute container 58 to be extracted from the main parachute housing 52. As the line 60 connecting the pilot chute 56 to the main parachute housing 52 and the main parachute line 62 are fully extended, the force of the resulting jerk is sufficient to break the cotton ties 64 which hold the main chute 18 within the main chute container 58. As the cotton ties 64 break, the main parachute is deployed, as illustrated in FIG. 4. With the main parachute 18 deployed, the flare descends at a rate of approximately 13 ft/Sec.

The flare ignition system 22, as illustrated in FIG. 1, is armed upon initial acceleration of the flare. The forces due to the acceleration of the flare cause a "zig zag" safety block 70 to compress a spring 72. The safety block 70 and spring 72 are concentrically mounted about a mounting column. The safety block 70 includes a pawl which rides in a zig-zag shaped track located within the mounting column. In order for the safety block to follow the track and completely compress the spring, the flare must have an acceleration of 60 g-forces over a period of about one second.

Once armed, the flare is ignited by pulling an ignition lanyard 74. The ignition lanyard is attached at one end to the main chute line 62 and at the other end to the ignition system 22. The ignition lanyard passes from the main chute line to the ignition system along a raceway between the illuminant 20 and the canister. Within the ignition system 22, the lanyard is attached to a slider 78.

Upon deployment of the main parachute 18 (FIG. 3), the ignition lanyard 74 is pulled, causing the slider 78 to move across its track. A hammer (not shown) is retracted against a spring as the slider 78 is pulled across its track. As the slider 78 reaches the end of its track, the hammer is released and, under the force of the spring, strikes a priming cap which fires into a pellet basket 80 containing a number of $BKNO_3$ pellets.

As best viewed in FIG. 1, a layer of foam 82 serves to tightly pack the pellets as a guard against vibration of the pellets. As the pellets burn, the heat from the pellets ignites the propellant wafer 84. Ignition of the pellets and wafer 84 generates sufficient heat to ignite the flare illuminant 20 at the head end of the flare. Additionally, the internal gas pressure generated upon ignition of the wafer 84 blows the ignition system 22 off of the flare (FIG. 4), leaving the flare open to the atmosphere and permitting the approximate 1 million candle power of light generated by the flare to shine out of the flare canister and onto the area to be illuminated.

The M-257 was originally designed to work with a fixed-delay fuse. The standard fixed-delay fuse utilized in the M-257 provides a constant delay of 13.5 seconds from launch to flare ignition. This corresponds to a fixed standoff range of about 4,200 meters from launcher to target and a parachute deployment velocity of 250 m/sec.

In recent years, however, the demand for a variable range flare has resulted in the development of variable delay fuses. The range of the flare is thus controlled by utilizing a fuse which can vary the time between when the rocket motor fires and when the drogue parachute deploys.

A significant disadvantage to the ignition system 22 of the M-257 is that it is not reliable over a wide range of parachute deployment velocities. At particularly low velocities, the force on the ignition lanyard resulting from the deployment of the main parachute is insufficient to trigger the firing of the ignition system. Additionally, at high velocities, the extreme jerk on the ignition lanyard frequently results in the lanyard being broken without pulling the slider and triggering ignition of the ignition system.

The M-257 ignition system incorporates a variety of parts, such as the safety block 70, the slider 78 and the hammer and priming cap mechanism which ignites the pellet basket 80. All of these parts add to the complexity of the manufacture of the ignition system. Incorporating so many mechanisms which must all function together properly in order for the flare to be ignited presents an increased probability of malfunction over more simple designs.

Thus, it would be an advancement in the art to provide an improved ignition system for a flare warhead which would function effectively regardless of flare velocity at the time the ignition system is triggered.

Indeed, it would be an advancement in the art to provide such an ignition system which reduced the number of moving parts thereby enabling the ignition system to be simpler to manufacture and more reliable than prior-art ignition systems.

Such an improved flare ignition system is disclosed and claimed herein.

BRIEF SUMMARY AND OBJECTS OF THE INVENTION

The present invention is directed to a novel ignition system for use with a flare warhead. The ignition system includes a combustible train, one end of which is positioned in communication with the fuse or other ignition initiator. Upon firing of the fuse, combustion of the combustible train is triggered. The opposite end of the combustible train is positioned in communication with an illuminant igniter such that the firing of the combustible train may trigger combustion of the illuminant igniter, thereby permitting the illuminant to be ignited.

In a preferred embodiment, the improved ignition system of the present invention is designed for use with fuses, both fixed and variable range, which fire a separation charge. In accordance with the teachings of the present invention, a pickup charge is positioned adjacent the separation charge such that the pickup charge will combust upon firing of the separation charge.

Because the separation charges used in flare warheads are generally propellant wafers, they do not generate a significant explosive shock when fired. Thus, the pickup charge must be heat sensitive in order to be ignited by the separation charge. Unlike the separation charge, however, the pickup charge generates a mild explosive shock when it is fired.

The pickup charge is configured such that a portion of it is positioned adjacent a combustible train. The combustible train preferably comprises a continuous pyrotechnic composition such as a thin-layer, shock-sensitive explosive composition positioned within a plastic tube. The combustible composition within the combustible train is thus selected such that combustion may be triggered by the firing of the pickup charge. In a preferred embodiment, the pyrotechnic composition has a combustion velocity of approximately 18,000 ft/sec.

The combustible train is located in a raceway between the illuminant and the flare casing. At the head end of the flare, the combustible train is positioned in communication with an output charge. In a preferred embodiment, the composition within the combustible train does not generate any significant amount of heat, nor is it heat sensitive. Thus, the output charge must be shock sensitive.

The output charge is positioned in communication with the standard $BKNO_3$ pellet basket utilized on most illuminant igniters such that firing of the output charge will ignite the pellet basket. From that point, the illuminant ignition sequence proceeds as though the pellet basket had been ignited by prior-art methods.

Because the $BKNO_3$ pellets are not shock sensitive, the output charge must generate substantial heat in order to ignite the pellet basket. However, the output charge is preferably selected such that firing of the output charge will not generate a sufficient explosive shock to initiate the pyrotechnic train. This enables the flare to pass Insensitive Munitions cookoff tests. When subjected to continuously increasing temperatures, should the heat cause the output charge to ignite, the pyrotechnic ignition system will not fire in reverse.

Additionally, the pyrotechnic ignition system is configured such that the plastic tubing in which the combustible train is housed has a melting temperature less than the temperature required to fire the ignition initiator or the illuminant igniter. Consequently, when the flare is subjected to continuously increasing temperatures, the plastic tubing will melt and destroy the continuity of the combustible train before the ignition initiator or the illuminant igniter are ignited. Without continuity of the pyrotechnic composition in the combustible train, any heat-induced firing of the ignition initiator or the illuminant igniter will not transfer combustion to the opposite end of the flare.

A significant advantage of the pyrotechnic ignition system of the present invention is that it is not dependent upon parachute deployment or any other velocity-based parameter for successful operation. Because it is triggered by the firing of the separation charge rather than by parachute deployment, it will successfully ignite the illuminant regardless of flare velocity. Thus, the combustible ignition system of the present invention is ideally suited for use with flares incorporating variable range fuses.

It is, therefore, an object of the present invention to provide an improved ignition system for a flare warhead which functions effectively regardless of flare velocity at the time the ignition system is triggered.

It is a further object of the present invention to provide such an ignition system which reduces the number of moving parts, thereby enabling the ignition system to be simpler to manufacture and more reliable than prior-art ignition systems.

It is an additional object of the present invention to provide such an improved ignition system which passes Insensitive Munitions cookoff tests.

These and other objects and advantages of the present invention will become more fully apparent by examination of the following description of the preferred embodiments and the accompanying drawings.

BRIEF DESCRIPTION OF THE DRAWINGS

In order that the manner in which the above-recited and other advantages and objects of the invention are obtained, a more particular description of the invention briefly described above will be rendered by reference to the appended drawings. Understanding that these drawings only provide data concerning typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
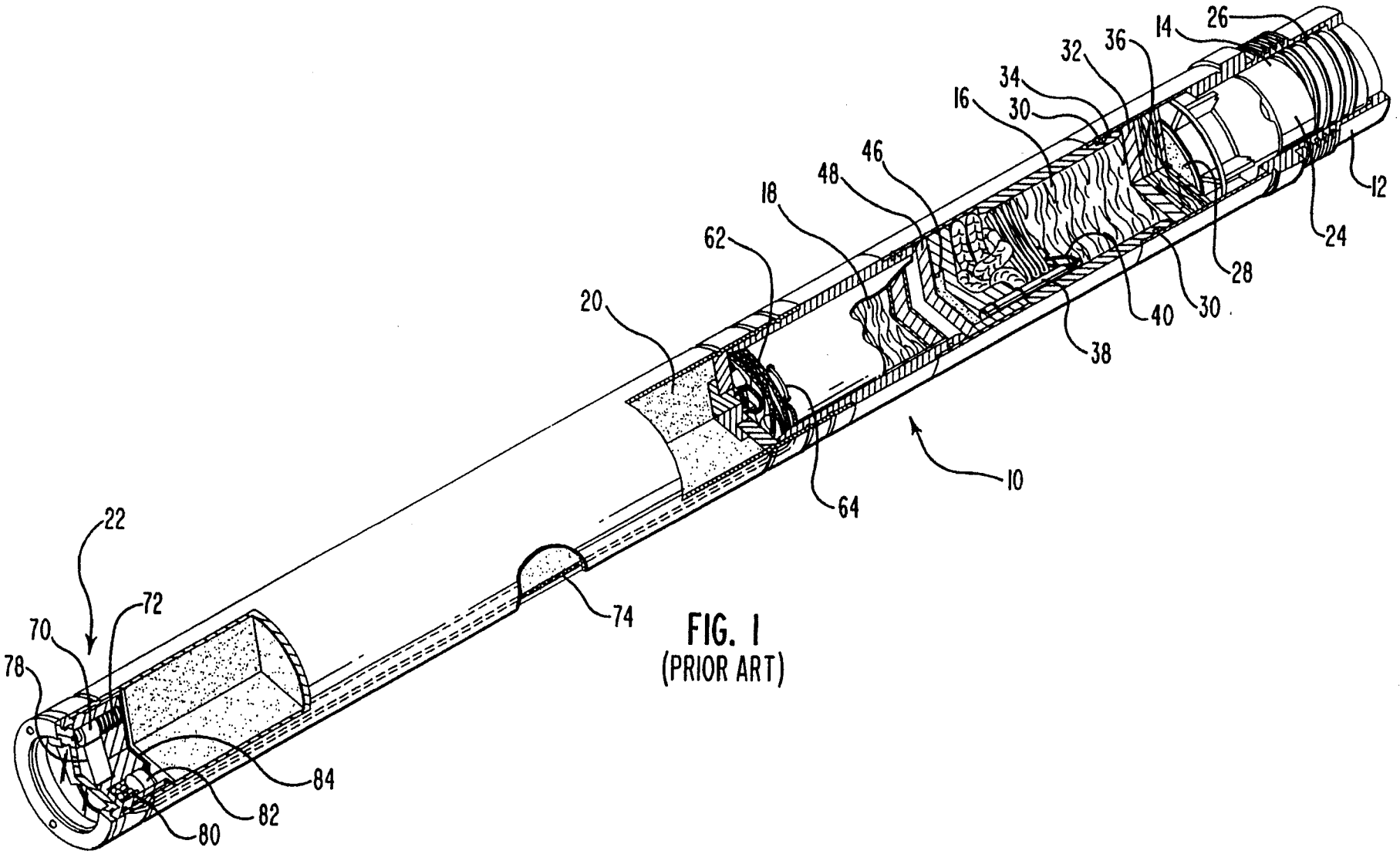
FIG. 1 (PRIOR ART)
FIG. 1 is a perspective view of a prior-art M-257 warhead, with portions of the flare casing cut away to more particularly illustrate some of its features.
Figure 2:
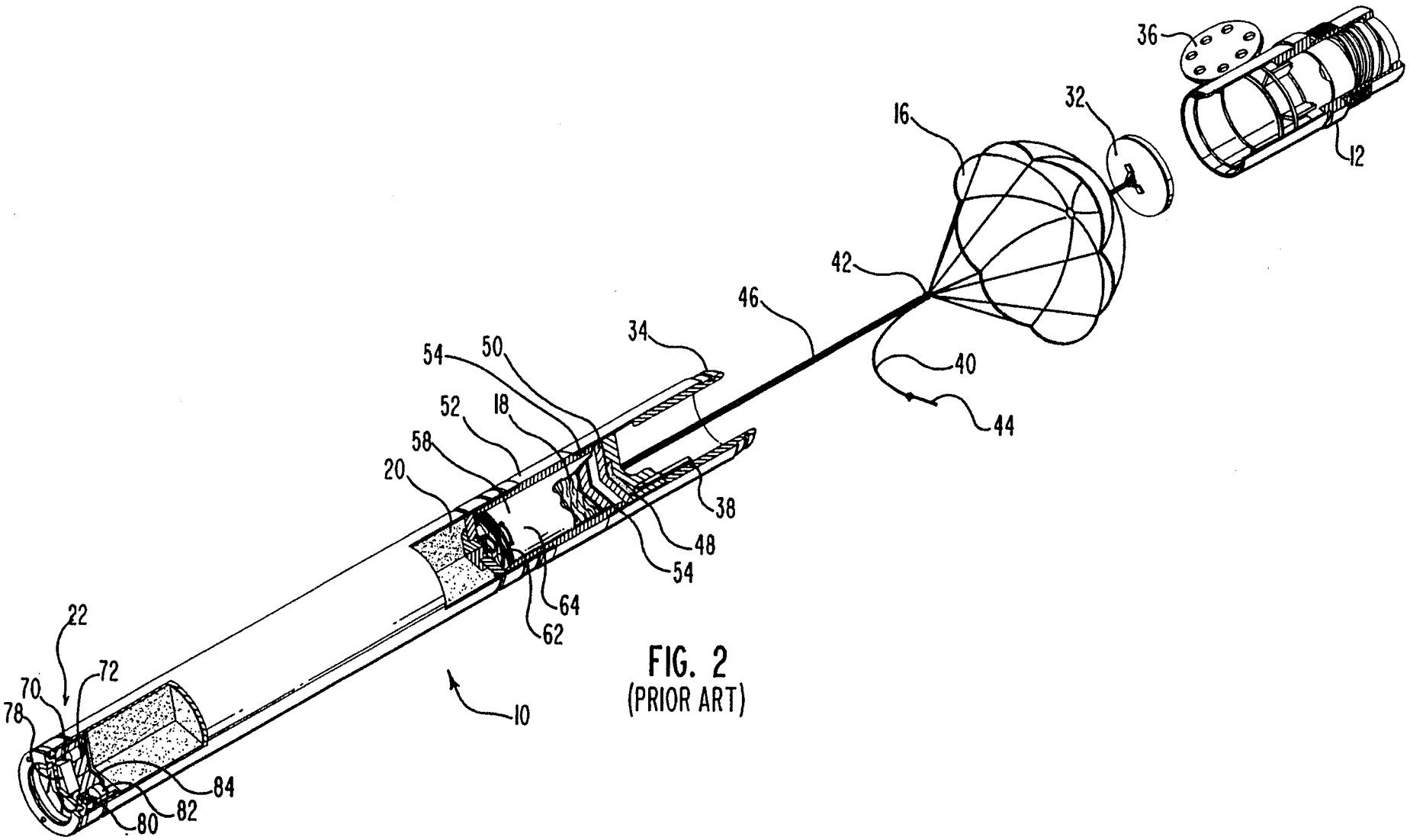
FIG. 2 (PRIOR ART)
FIG. 2 is a perspective view of the warhead of FIG. 1 with the drogue parachute deployed and portions of the flare casing cut away.
Figure 3:
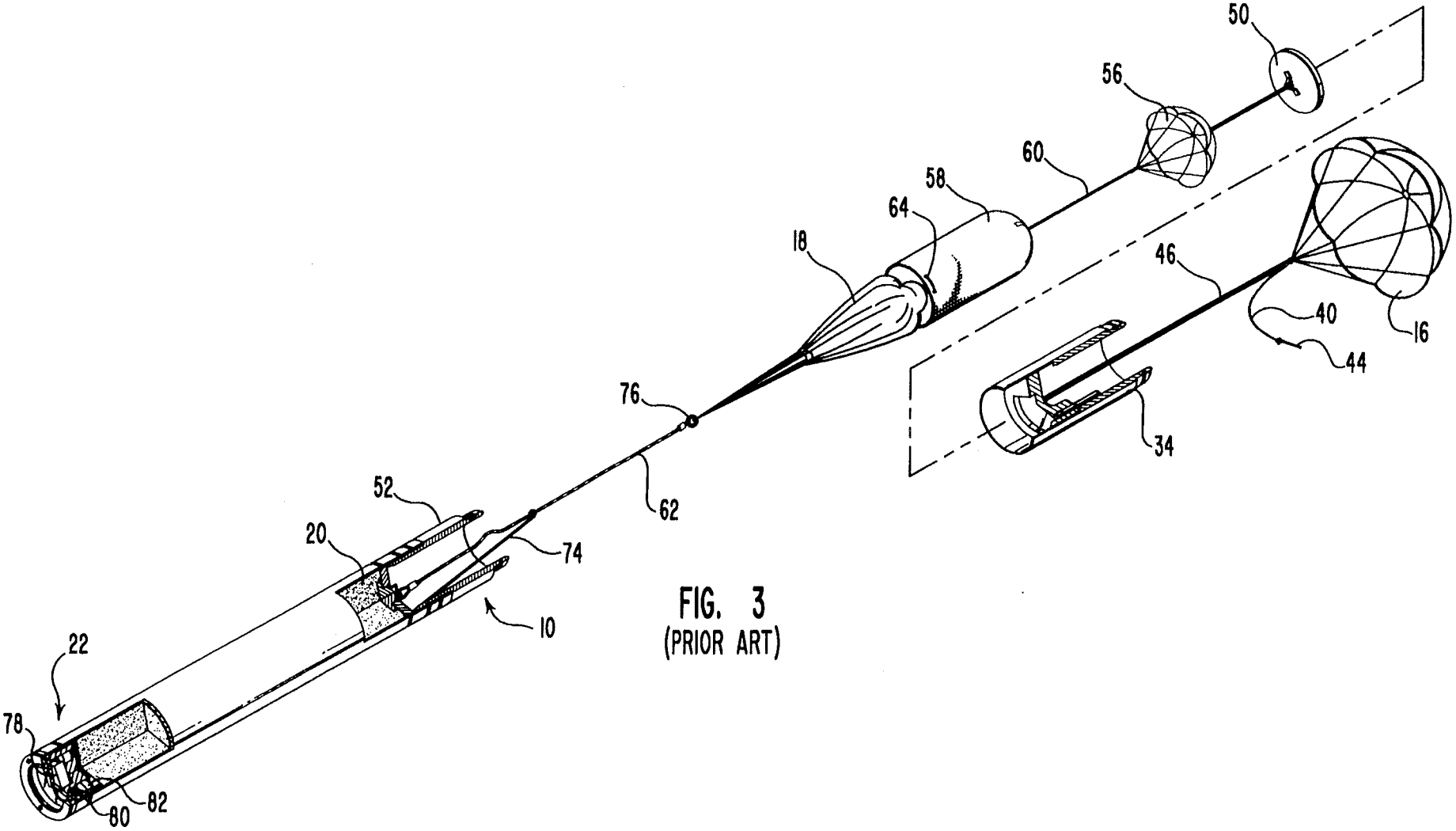
FIG. 3 (PRIOR ART)
FIG. 3 is a perspective view of the warhead of FIG. 1 with the pilot parachute deployed and portions of the flare casing cut away.
Figure 4:
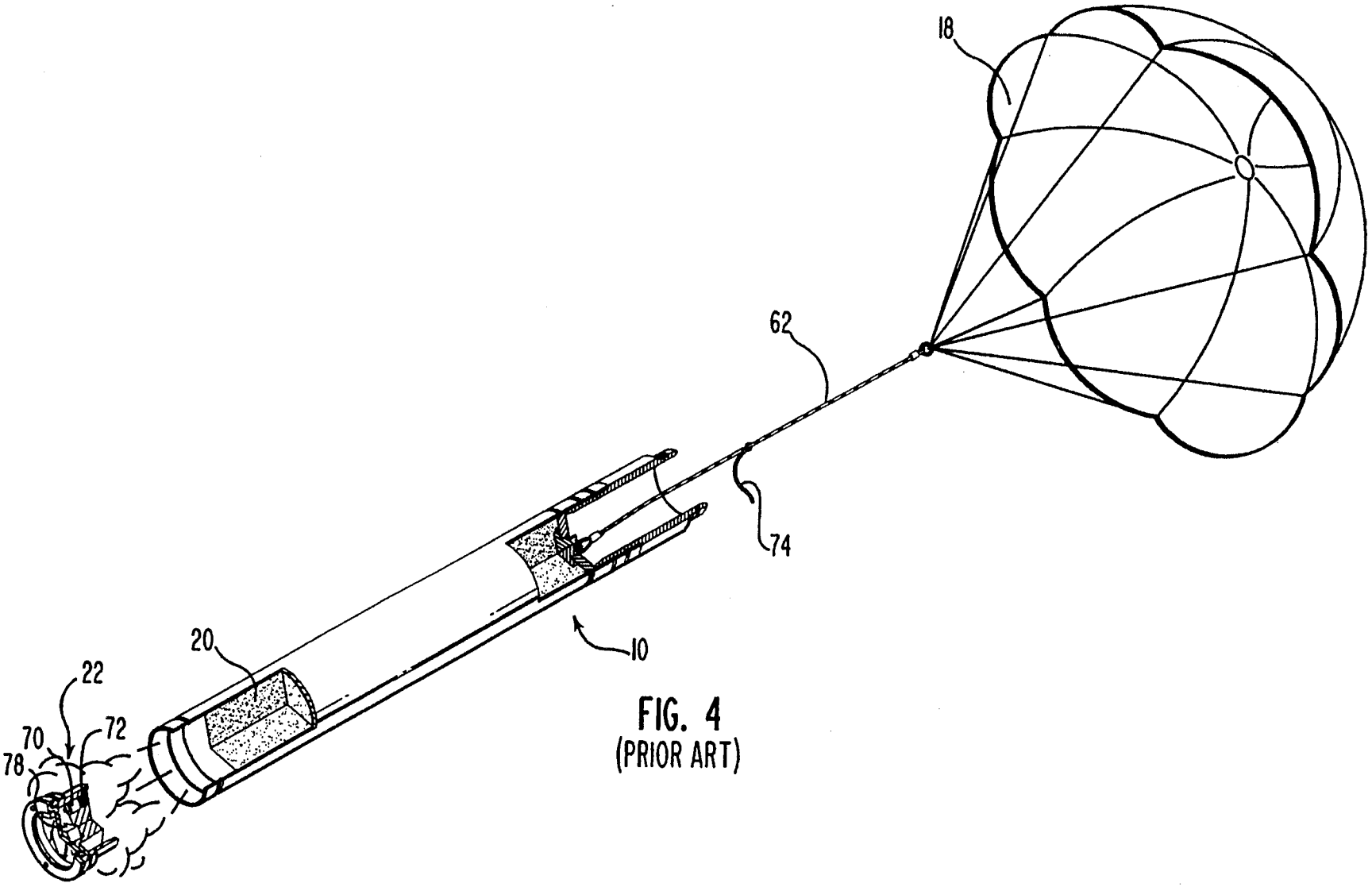
FIG. 4 (PRIOR ART)
FIG. 4 is a perspective view of the warhead of FIG. 1 with the main parachute deployed and portions of the flare casing cut away.
Figure 5:
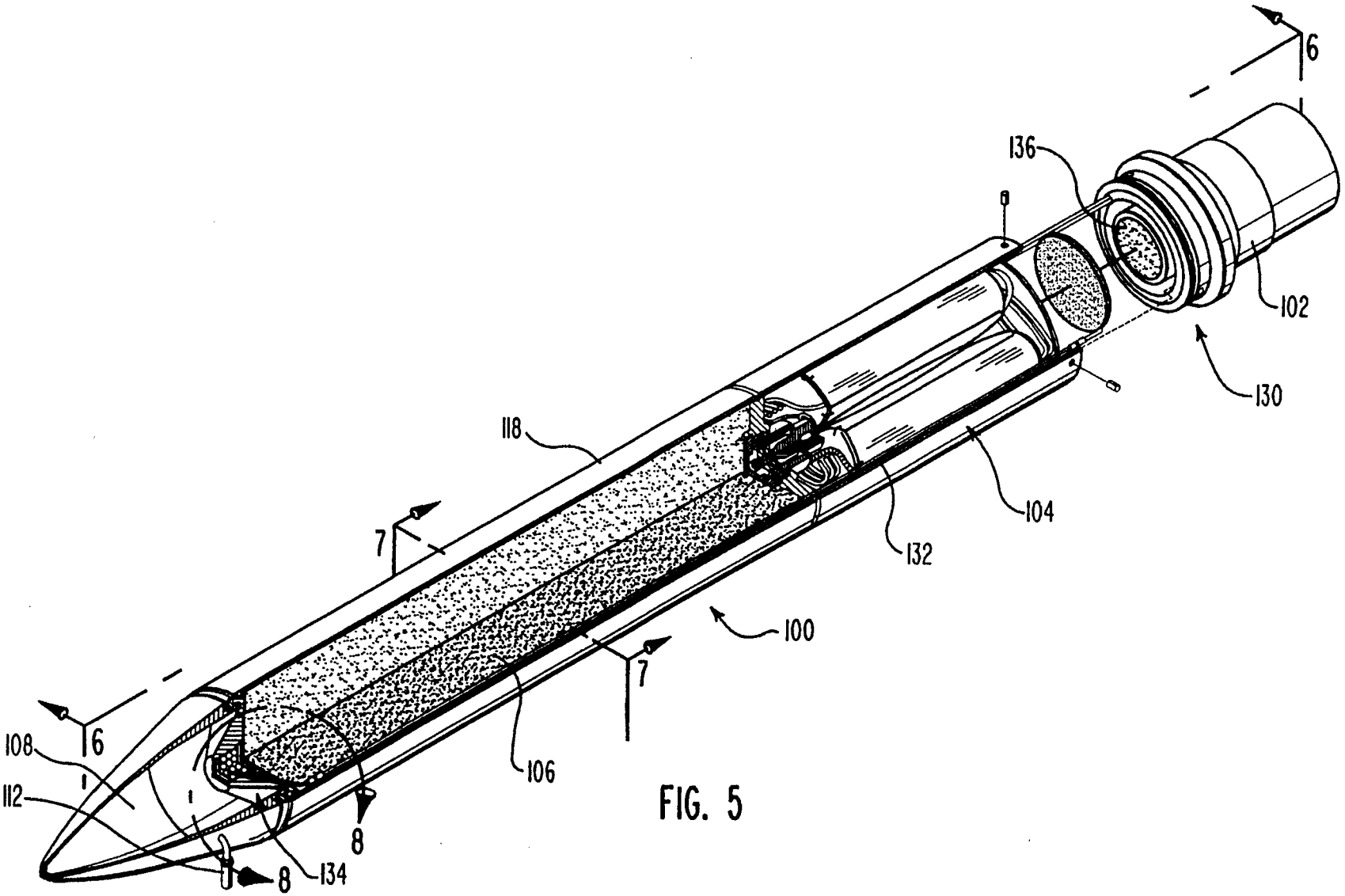
FIG. 5 is a partially exploded, perspective view of an illuminating flare warhead incorporating the combustible ignition system of the present invention, with portions cut away to more particularly illustrate the invention.
Figure 6:
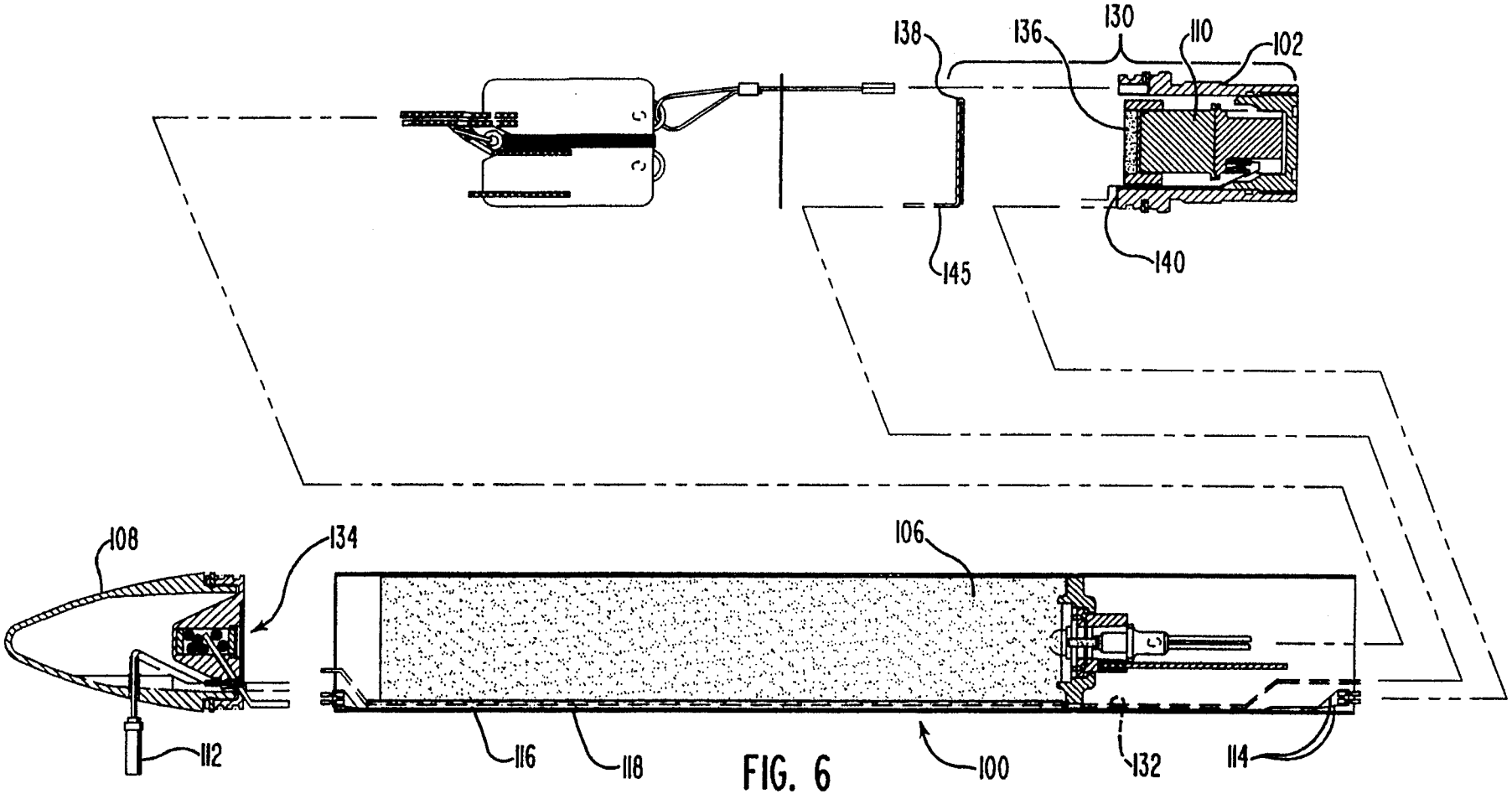
FIG. 6 is an exploded cross-sectional view taken along line 6—6 of FIG. 1.

Reference is now made to the figures wherein like parts are referred to by like numerals throughout. With particular reference now to FIGS. 5 and 6, a flare warhead incorporating a combustible ignition system according to the teachings of the present invention is generally designated at 100. The warhead 100 includes a motor adapter 102, a parachute deployment system 104, flare illuminant 106 and a nose cone 108.

Motor adapter 102 is used to mount the warhead 100 onto a propulsion device such as a rocket motor (not shown). Motor adapter 102 may include any of those motor adapters conventionally known for use with military warheads, and may include threads to connect the warhead to the propulsion device.

Within the bore of the motor adapter 102 is housed a fuse 110 (FIG. 6). Fuse 110 may include any of a variety of conventionally available fuses, including fixed and variable range fuses. Indeed, the combustible ignition system of the present invention is ideally suited for use with variable range fuses in that it is not velocity dependent, i.e., it may successfully ignite the flare illuminant 106 at any velocity.

A coaxial umbilical cable 112 permits the fuse 110 to be set from a remote location, such as from the cockpit of a helicopter or airplane. The umbilical cable 112 mates with the launching aircraft control system and is electrically connected to the fuse 110 via a flat cable 114 (FIG. 6) passing under or through or under a raceway 116 between the illuminant 106 and the flare casing 118.

The parachute deployment system 104 is used to assist in decelerating the warhead and permitting it to slowly descend while the flare illuminates a target area. The parachute deployment system 104 used may be any of those commonly known in the art. Preferably, however, the parachute deployment system is that disclosed in U.S. Patent Application entitled Parachute Deployment System invented by Evan E. Day and filed Nov. 12, 1992. That disclosure is specifically incorporated herein by this reference.

The combustible ignition system of the present invention includes an ignition initiator 130 positioned in communication with a combustible train 132 such that firing of the ignition initiator 130 may trigger combustion of the combustible train 132. The ignition system further includes an illuminant igniter 134 positioned in communication with the combustible train 132 such that the firing of the combustible train 132 may trigger the firing of the illuminant igniter 134, thereby permitting the illuminant 106 to be ignited.

Thus, in contrast to prior-art ignition systems which typically employ an ignition lanyard which is pulled upon deployment of a parachute, the ignition system of the present invention is actuated upon firing of the fuse. Thus, the ignition system of the present invention operates independently of flare velocity. Advantageously, the ignition system of the present invention will successfully operate regardless of flare velocity at the time of actuation.

In the preferred embodiment of the invention, the ignition initiator 130 includes fuse 110 which operates to ignite a separation charge 136. The separation charge 136 may be any of those separation charges conventionally known for use with such warheads, and generally includes a 5.1 to 5.5 gram charge of M-9 propellant. Such a separation charge deflagrates in about 100 milliseconds; thus, it does not impart an explosive shock of any significance.

The ignition initiator 130 further includes a pickup charge 138 positioned substantially contiguous separation charge 136. Pickup charge 138 must be configured and positioned relative to the separation charge 136 such that the firing of the separation charge 136 will trigger combustion of the pickup charge 138. In this presently preferred embodiment of the invention, the pickup charge 138 is configured in a substantially disk shape, thereby providing maximum area exposure to the separation charge 136. The pickup charge 138 is positioned against a collar 140 (FIG. 6) on the head end of the motor adapter 102. Thus, upon firing of the separation charge 136, the heat from the combusting separation charge 136 will initiate the pickup charge 138.

While pickup charge 138 may include a variety of compositions, it is presently preferred that it comprise a mild explosive composition such as Hivelite ® available from Teledyne/McCormick-Selph Corp. of Holister, Calif. In this preferred embodiment of the invention, the pickup charge 138 has a combustion velocity of approximately 5,000 ft/sec. Pickup charge 138 must be selected such that firing of the separation charge 136 will trigger combustion in the pickup charge 138. Thus, the combustion parameters of the pickup charge 138 depend on the nature of the separation charge 136 which is employed.

Figure 7:
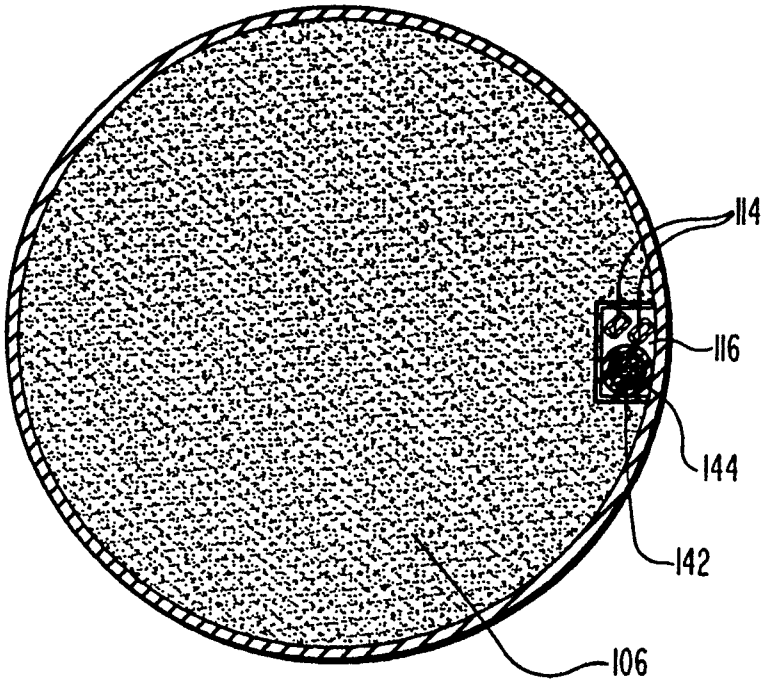
FIG. 7 is a cross-sectional view taken along line 7—7 of FIG. 1.

Firing of the pickup charge 138 triggers combustion of the combustible train 132. As illustrated in FIG. 7, combustible train 132 includes a continuous combustible composition 142 positioned within a meltable tube such as plastic tubing 144. To ensure firing of the combustible train 132 upon the firing of the pickup charge 138, the pickup charge 138 is further configured with an extension arm 145 (FIG. 6) which fits within the end of plastic tubing 144 to thereby place the pickup charge 138 in substantially contiguous communication with the combustible composition 142.

Preferably, the combustible composition 142 is a pyrotechnic composition. As used herein, a "pyrotechnic" composition is any combustible composition having a combustion velocity greater than about 10 feet per second. In this preferred embodiment, the combustible composition 142 comprises a thin-layer explosive composition having a combustion velocity of approximately 18,000 feet per second, such as that sold as "TLX" by Explosive Technologies of Fairfield, Calif.

The combustible composition 142 is preferably a shock-sensitive and shock generating explosive which will detonate when subjected to the shock generated by combustion of the pickup charge 138. Also, it is presently preferred that the combustible composition 142 not be heat sensitive. By avoiding heat-sensitive materials as the combustible composition 142 in the combustible train 132, the resulting warhead is less sensitive, as it becomes less likely that the combustible train 132 would be triggered by increasing temperatures such as, for example, those encountered should the warhead be exposed to fire.

In selecting an appropriate combustible composition 142, care must be taken to ensure that the combustible train 132 will not ignite the flare illuminant 106 along the raceway 116 when the combustible train 132 is fired. This problem is preferably addressed by selecting a composition, such as the high-velocity, thin-layer explosive utilized in this embodiment, which does not generate any significant amount of heat upon combustion. Alternatively, the raceway 116 may be insulated to prevent any heat generated by the combustible composition 142 from igniting the illuminant 106 along the raceway 116.

Figure 8:
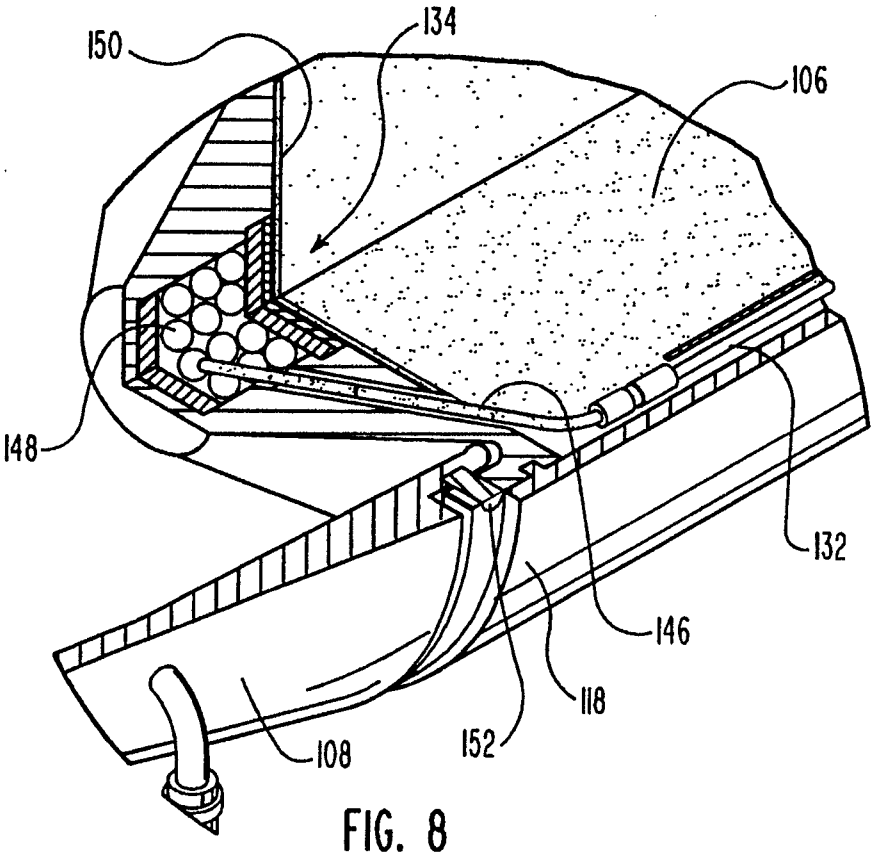
FIG. 8 is a perspective view taken along line 8—8 of FIG. 1, with portions cut away to more clearly illustrate the invention.

Referring now to FIG. 8, the head end of the combustible train 132 is positioned in communication with an output charge 146. In this embodiment, output charge 146 is a solid pyrotechnic strand which, at its aft end, fits within the end of plastic tube 144 to place the output charge 146 substantially contiguous the combustible composition 142 of the combustible train 132.

Output charge 146 must be selected such that combustion of the combustible train 132 will trigger combustion of the output charge 146. However, the output charge 146 and the combustible composition 142 are preferably selected such that combustion of the output charge 146 will not trigger combustion of the combustible composition 142. By so selecting output charge 146 and combustible composition 142, reverse firing of the ignition system is avoided.

The output charge 146 is placed in communication with the illuminant igniter 134 such that firing of the output charge 146 will trigger the firing of the illuminant igniter 134. Thus, the combustion parameters of the output charge 146 must be selected according to the type of illuminant igniter 134 employed. In this embodiment of the invention, the illuminant igniter 134 includes a basket of $BKNO_3$ pellets 148. As an alternative to $BKNO_3$ pellets, magnesium/teflon pellets may also be used. Thus, the output charge 146 must be capable of generating sufficient heat to ignite the pellets 148. The output charge 146 thus acts as a medium to transfer explosive shock from the combustible train 132, convert that explosive shock into heat and transfer that heat to the pellets 148.

The illuminant igniter 134 also includes a propellant wafer 150 positioned adjacent the $BKNO_3$ pellets 148 such that the propellant wafer 150 is ignited upon ignition of the $BKNO_3$ pellets 148. Heat generated by the combustion of the propellant wafer 150 is sufficient to ignite the illuminant 106. Additionally, the gas pressure within the nose cone 108 resulting from combustion of the propellant wafer 150 causes the shearing of shear pins 152 which secure the nose cone 108 to the casing 118. Following the shearing of shear pins 152, the separation force of the gas pressure causes separation of the nose cone 108 from the casing 118, thereby exposing the burning illuminant 106 to the atmosphere.

The various components of the combustible ignition system of the present invention are preferably selected such that the resulting warhead will pass Insensitive Munitions cookoff tests. To minimize the sensitivity of the warhead, the plastic tubing utilized in the combustible train 132 is preferably made of a material having a melting temperature less than the ignition temperature of the ignition initiator 130 and the illuminant igniter 134. Thus, when the warhead 100 is exposed to continuously increasing temperatures, the plastic tubing 144 will melt and destroy the continuity of the combustible composition 142 before the ignition initiator 130 or the illuminant igniter 134 are ignited.

In this presently preferred embodiment of the invention, the plastic tube 144 is a polyethylene tube having a melting temperature of less than about 240 degrees Fahrenheit. The separation charge 136 within the ignition initiator has an ignition temperature of approximately 270 degrees Fahrenheit. And, the propellant wafer 150 in the illuminant igniter 134 has an ignition temperature of approximately 350 degrees Fahrenheit. Thus, in an Insensitive Munitions cook-off test, the polyethylene tube melts and destroys the continuity of the combustible composition 142 before either the separation charge 136 or the propellant wafer 150 ignite.

From the foregoing, it will be appreciated that the combustible ignition system of the present invention provides an improved ignition system for a flare warhead which functions effectively regardless of flare velocity at the time the ignition system is triggered. The present invention reduces significantly the number of moving parts typically employed in flare ignition systems, thereby enabling the ignition system to be simpler to manufacture and more reliable than prior-art ignition systems. Further, the present invention provides an improved ignition system which passes Insensitive Munitions cookoff tests.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An ignition system for an illuminant containing warhead, comprising:

an ignition initiator;

a combustible train, comprising a material which is shock sensitive and which is not heat sensitive, in communication with said ignition initiator such that the firing of said ignition initiator triggers combustion of said combustible train; and an illuminant igniter positioned in communication with said combustible train such that the firing of said combustible train triggers the firing of said illuminant igniter, thereby permitting the illuminant to be ignited, the illuminant igniter configured such that inadvertent firing of the illuminant igniter will not trigger combustion of the combustible train.

2. An ignition system as defined in claim 1, wherein said combustible train comprises a continuous pyrotechnic composition.

3. An ignition system as defined in claim 1, further comprising an output charge positioned contiguous said combustible train such that the firing of said combustible train triggers combustion of said output charge, said output charge configured such that the firing of said output charge triggers the firing of said illuminant igniter.

4. An ignition system as defined in claim 3, wherein said output charge and said combustible train are selected such that the firing of said output charge will not trigger combustion of said combustible train.

5. An ignition system as defined in claim 1, wherein said combustible train comprises a continuous combustible composition positioned within a meltable tubing.

6. An ignition system as defined in claim 5, wherein said ignition initiator and said meltable tubing are selected such that if said ignition initiator may be ignited by heat, the ignition temperature of said ignition initiator is greater than the melting temperature of said meltable tubing, such that exposure of the warhead to continuously increasing temperatures will result in said meltable tubing melting and destroying the continuity of said continuous combustible composition before said ignition initiator ignites.

7. An ignition system as defined in claim 5, wherein said illuminant igniter and said meltable tubing are selected such that if said illuminant igniter may be ignited by heat, the ignition temperature of said illuminant igniter is greater than the melting temperature of said meltable tubing, such that exposure of the warhead to continuously increasing temperatures will result in said meltable tubing melting and destroying the continuity of said continuous combustible composition before said illuminant igniter ignites.

8. An ignition system as defined in claim 1, wherein the warhead is attached to a propulsion device, and wherein said ignition initiator comprises a separation charge for promoting the separation of the propulsion device from the illuminant containing warhead.

9. An ignition system as defined in claim 8, wherein said ignition initiator further comprises a pickup charge positioned in communication with said separation charge such that the firing of said separation charge triggers combustion of said pickup charge, said pickup charge positioned contiguous to said combustible train such that the firing of said pickup charge triggers combustion of said combustible train.

10. An ignition system as defined in claim 8, wherein said ignition initiator comprises a fuse positioned in communication with said separation charge such that the firing of said fuse triggers combustion of said separation charge.

11. An ignition system as defined in claim 10, wherein said fuse comprises a variable range fuse.

12. A pyrotechnic ignition system for use in igniting illuminant in a warhead, the warhead attached to a propulsion device, comprising:

an ignition initiator, comprising:

a fuse; and a separation charge for promoting the separation of the propulsion device from the warhead, said separation charge positioned in communication with said fuse such that the firing of said fuse triggers combustion of said separation charge;

a pyrotechnic train positioned in communication with said separation charge such that the firing of said separation charge triggers combustion of said pyrotechnic train, said pyrotechnic train comprising a continuous pyrotechnic composition which is shock sensitive and which is not heat sensitive;

an output charge positioned contiguous said pyrotechnic train such that the firing of said pyrotechnic train triggers combustion of said output charge; and an illuminant igniter positioned in communication with said output charge such that the firing of said output charge triggers the firing of said illuminant igniter, thereby permitting the illuminant to be ignited, the illuminant igniter and output charge configured such that inadvertent firing of the illuminant igniter will not trigger combustion of the combustible train.

13. A pyrotechnic ignition system as defined in claim 12, wherein said fuse comprises a variable range fuse.

14. A pyrotechnic ignition system as defined in claim 12, further comprising a pickup charge positioned in communication with said separation charge such that the firing of said separation charge triggers combustion of said pickup charge, said pickup charge positioned contiguous to said pyrotechnic train such that the firing of said pickup charge triggers combustion of said pyrotechnic train.

15. A pyrotechnic ignition system as defined in claim 12, wherein said output charge comprises a shock-sensitive combustible composition.

16. A pyrotechnic ignition system as defined in claim 12, wherein said continuous pyrotechnic composition is positioned within a plastic tubing.

17. A pyrotechnic ignition system as defined in claim 16, wherein said plastic tubing comprises polyethylene tubing.

18. A pyrotechnic ignition system as defined in claim 16, wherein said ignition initiator and said plastic tubing are selected such that if said ignition initiator may be ignited by heat, the ignition temperature of said ignition initiator is greater than the melting temperature of said plastic tubing, such that exposure of the warhead to continuously increasing temperatures will result in said plastic tubing melting and destroying the continuity of said continuous pyrotechnic composition before said ignition initiator ignites.

19. A pyrotechnic ignition system as defined in claim 18, wherein said plastic tubing has a melting temperature less than about 240° F. and said separation charge is heat sensitive and has an ignition temperature of at least about 270° F.

20. A pyrotechnic ignition system as defined in claim 16, wherein said illuminant igniter and said plastic tubing are selected such that if said illuminant igniter may be ignited by heat, the ignition temperature of said illuminant igniter is greater than the melting temperature of said plastic tubing, such that exposure of the warhead to continuously increasing temperatures will result in said plastic tubing melting and destroying the continuity of said continuous pyrotechnic composition before said illuminant igniter ignites.

21. A pyrotechnic ignition system as defined in claim 20, wherein said plastic tubing has a melting temperature less than about 240° F. and aid illuminant igniter comprises a heat-sensitive combustible composition having an ignition temperature of at least about 350° F.

22. An insensitive pyrotechnic ignition system for use with a variable range, illuminant containing warhead, the warhead attached to a propulsion device, comprising:

a variable range fuse;

a separation charge for promoting the separation of a propulsion device from the warhead, said separation charge positioned in communication with said fuse such that the firing of said fuse ignites said separation charge;

a pickup charge positioned in communication with said separation charge such that the firing of said separation charge triggers combustion of said pickup charge;

a pyrotechnic train positioned contiguous to said pickup charge such that the firing of said pickup charge triggers combustion of said pyrotechnic train, said pyrotechnic train comprising a continuous pyrotechnic composition positioned within a plastic tubing, said plastic tubing selected such that the melting temperature of said plastic tubing is less than the ignition temperature of said separation charge and of said pickup charge, such that exposure of the warhead to continuously increasing temperatures will result in said plastic tubing melting and destroying the continuity of said continuous pyrotechnic composition before either of said separation charge and said pickup charge ignites;

an output charge positioned contiguous said pyrotechnic train such that the firing of said pyrotechnic train triggers combustion of said output charge, said output charge selected such that the firing of said output charge will not trigger combustion of said pyrotechnic train; and an illuminant igniter positioned in communication with said output charge such that the firing of said output charge triggers the firing of said illuminant igniter, thereby permitting the illuminant to be ignited.

23. An insensitive pyrotechnic ignition system as defined in claim 22, wherein said continuous pyrotechnic composition is not heat sensitive.

24. An insensitive pyrotechnic ignition system as defined in claim 23, wherein said continuous pyrotechnic composition comprises a shock-sensitive explosive composition having a combustion velocity greater than about 5,000 ft/sec.

25. An insensitive pyrotechnic ignition system as defined in claim 22, wherein said plastic tubing has a melting temperature less than about 240° F. and said illuminant igniter comprises a heat-sensitive combustible composition having an ignition temperature of at least about 350° F.

26. An insensitive pyrotechnic ignition system as defined in claim 25, wherein said output charge comprises a shock-sensitive combustible composition and said continuous pyrotechnic composition comprises a shock-sensitive and shock-generating composition.

27. An insensitive pyrotechnic ignition system as defined in claim 25, wherein said pickup charge comprises a shock-sensitive combustible composition and said continuous pyrotechnic composition comprises a shock-sensitive and shock-generating composition.

28. An ignition system for an illuminant containing warhead attached to a propulsion device, comprising:

an ignition initiator comprising a separation charge for promoting the separation of the propulsion device from the illuminant containing warhead, and a variable range fuse positioned in communication with the separation charge such that the firing of the fuse triggers combustion of the separation charge;

a combustible train positioned in communication with the ignition initiator such that the firing of the ignition initiator triggers combustion of the combustible train; and an illuminant igniter positioned in communication with the combustible train such that the firing of the combustible train triggers the firing of the illuminant igniter, thereby permitting the illuminant to be ignited.

29. An ignition system for an illuminant containing warhead, the warhead attached to a propulsion device, comprising:

an ignition initiator comprising a separation charge for promoting the separation of the propulsion device from the illuminant containing warhead, and a pickup charge positioned in communication with the separation charge such that the firing of the separation charge triggers combustion of the pickup charge;

a combustible train positioned contiguous to the pickup charge such that the firing of the pickup charge triggers combustion of the combustible train; and an illuminant igniter positioned in communication with the combustible train such that the firing of the combustible train triggers the firing of the illuminant igniter, thereby permitting the illuminant to be ignited.

30. An ignition system for an illuminant containing warhead, comprising:

an ignition initiator;

a combustible train positioned in communication with the ignition initiator such that the firing of the ignition initiator triggers combustion of the combustible train, the combustible train comprising a continuous combustible composition positioned within a meltable tubing; and an illuminant igniter positioned in communication with the combustible train such that the firing of the combustible train triggers the firing of the illuminant igniter, thereby permitting the illuminant to be ignited.

31. An ignition system as defined in claim 30, wherein said ignition initiator and said meltable tubing are selected such that if said ignition initiator may be ignited by heat, the ignition temperature of said ignition initiator is greater than the melting temperature of said meltable tubing, such that exposure of the warhead to continuously increasing temperatures will result in said meltable tubing melting and destroying the continuity of said continuous combustible composition before said ignition initiator ignites.

32. An ignition system as defined in claim 30, wherein said illuminant igniter and said meltable tubing are selected such that if said illuminant igniter may be ignited by heat, the ignition temperature of said illuminant igniter is greater than the melting temperature of said meltable tubing, such that exposure of the warhead to continuously increasing temperatures will result in said meltable tubing melting and destroying the continuity of said continuous combustible composition before said illuminant igniter ignites.

* * * * *